US006972716B2

(12) United States Patent
Davis et al.

(10) Patent No.: US 6,972,716 B2
(45) Date of Patent: Dec. 6, 2005

(54) PHASED ARRAY ANTENNA ARCHITECTURE HAVING DIGITALLY CONTROLLED CENTRALIZED BEAM FORMING

(75) Inventors: William Davis, Santa Fe, NM (US); Robert Hladek, Rolling Hills Estates, CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 10/698,316

(22) Filed: Oct. 30, 2003

(65) Prior Publication Data

US 2005/0093744 A1 May 5, 2005

(51) Int. Cl.[7] ..... H01Q 3/22
(52) U.S. Cl. ..... 342/368; 342/372; 342/373
(58) Field of Search ..... 342/154, 361, 342/368, 372, 373

(56) References Cited

U.S. PATENT DOCUMENTS 5,132,694 A * 7/1992 Sreenivas ..... 342/373
5,327,150 A 7/1994 Cherrette
5,530,449 A 6/1996 Wachs et al.
5,724,972 A * 3/1998 Petrofsky ..... 600/437
6,308,085 B1 * 10/2001 Shoki ..... 455/562.1
6,351,240 B1 2/2002 Karimullah et al.
6,411,256 B1 6/2002 Lier et al.

* cited by examiner

*Primary Examiner*—Dao Phan
(74) *Attorney, Agent, or Firm*—Shimokaji & Associates, P.C.

(57) ABSTRACT

A phased array antenna includes a plurality of assemblies, each assembly including a plurality of elements and a plurality of digitally controlled centralized beam formers coupled to respective ones of the plurality of elements. The digitally controlled centralized beam formers may be disposed under the plurality of radiating elements and may be operable to provide a first signal to the respective ones of the plurality of radiating elements representative of a plurality of signals of a first polarization and a second signal representative of a plurality of signals of a second polarization. A method for distributing signals to a radiating element of a phased array antenna includes the steps of generating a first signal representative of a plurality of signals of a first polarization at a digitally controlled centralized beam former, and distributing the first signal to the radiating element. Similarly, the method and apparatus may be employed with digitally controlled receiving antenna, but with the signal flow reversed.

57 Claims, 8 Drawing Sheets

PHASED ARRAY ANTENNA ARCHITECTURE HAVING DIGITALLY CONTROLLED CENTRALIZED BEAM FORMING

BACKGROUND OF THE INVENTION

The present invention generally relates to apparatus and methods for phased array antennae and more particularly to apparatus and methods for a phased array antenna architecture having digitally controlled centralized beam forming.

Phased array antennae, particularly those deployed aboard spacecraft, find broad application in emerging applications, which provide for broadband and point-to-point communication. Such antennae provide for reconfigurable coverages in orbit without the necessity of physical design changes. As such, phased array antennae offer tremendous flexibility.

Conventional phased array antennae generally provide for beam forming at each individual radiating element of the antenna. For example, U.S. Pat. No. 5,530,449 to Wachs, et al. discloses a phased array antenna management system and calibration method including a phased array beam forming function performed by a digital processor that forms part of respective transmit and receive link payloads. The processor performs amplitude and phase control functions and provides control signals to the amplitude and phase drives of each array element. Another example, U.S. Pat. No. 6,411,256, discloses a beamformer of one type, but does not address the control function.

The approach of having a beam forming module for phase shifting and amplification of RF signals at each discreet element location suffers from several disadvantages. RF, DC, and digital lines in a high-density layout present packaging problems and require digital distribution across the whole phased array. Further, the proximity of the power amplifier to the beam forming module presents RF signal interaction problems. Additionally, multi-channel board layout present beam-to-beam isolation problems due to physical layout constraints and minimal signal line spacings. Further, the conventional design does not lend itself to easy adaptability to evolutionary designs involving different numbers of channels and signal beams. Finally, the conventional design concentrates many production, yield, and rework/part recall risks in the beam forming module. The beam forming architecture of U.S. Pat. No. 6,411,256, if digitally controlled, would force a digital signal to be distributed in orthogonal planes greatly increasing complexity and weight.

As can be seen, there is a need for a phased array antenna architecture having centralized beam forming and simplified digital control thereof. Such an architecture preferably provides for a centralized beam former assembly which is a self-contained thermal, structural, and power return network that distributes, amplifies, and commands signals within a discrete and modular subassembly. Further, such an architecture preferably provides functionality to form multiple beams in a centralized region of the assembly with final stage amplification being performed at the discreet array elements or between the beam former and a power sharing distribution network and the radiating elements in the case of defocused offset array driven designs. Additionally, such an architecture preferably separates high current amplifier lines from RF signal lines thereby decreasing isolation performance risk. Such an architecture also preferably allows for variable gain adjustment within discrete beam forming modules. Further, such an architecture preferably allows for more flexibility in evolutionary designs including varying numbers of signal beams and element counts. Further, such an architecture preferably allows for frequency offset between beam former and the power amplification section thus allowing the beam forming function to be performed at a lower frequency, lower frequencies typically being practical earlier than higher frequencies. Finally, such an architecture preferably separates high power amplification from the beam forming functions thereby allowing for decreased risk in yield, production, and rework.

SUMMARY OF THE INVENTION

In accordance with one aspect of the invention, a phased array antenna includes a plurality of assemblies, each assembly having a plurality of elements and a plurality of centralized beam formers coupled to respective ones of the plurality of elements.

In accordance with another aspect of the invention, a phased array antenna includes a plurality of assemblies, each assembly including a plurality of radiating elements and a plurality of centralized beam formers coupled to respective ones of the plurality of radiating elements, the centralized beam formers being disposed under the plurality of radiating elements and being operable to provide a first signal to the respective ones of the plurality of radiating elements representative of a plurality of signals of a first polarization and a second signal representative of a plurality of signals of a second polarization.

In another aspect of the invention, a phased array antenna includes a plurality of assemblies, each assembly including a plurality of receiving elements and a plurality of centralized beam formers coupled to respective ones of the plurality of receiving elements, the centralized beam formers being disposed under the plurality of receiving elements and being operable to receive a first signal from the respective ones of the plurality of receiving elements representative of a plurality of signals of a first polarization and a second signal representative of a plurality of signals of a second polarization.

In yet another aspect of the invention, a row assembly for use in a phased array includes a plurality of radiating elements and a plurality of centralized beam formers coupled to respective ones of the plurality of radiating elements.

In another aspect of the invention, a row assembly for use in a phased array includes a plurality of receiving elements and a plurality of centralized beam formers coupled to respective ones of the plurality of receiving elements.

In another aspect of the invention, a satellite system includes a satellite having disposed thereon a phased array antenna including a plurality of row assemblies, each row assembly having a plurality of elements and a plurality of centralized beam formers coupled to respective ones of the plurality of elements.

In yet another aspect of the invention, a method for distributing signals to a radiating element of a phased array antenna includes the steps of generating a first signal representative of a plurality of signals at a centralized beam former, and distributing the first signal to the radiating element.

In another aspect of the invention, a method for distributing signals to a radiating element of a phased array antenna includes the steps of generating a first signal representative of a plurality of signals at a centralized beam former, distributing the first signal to the radiating element, generating a second signal representative of a polarization at the centralized beam former, and distributing the second-signal to the radiating element.

These and other features, aspects and advantages of the present invention will become better understood with reference to the following drawings, description and claims.

DETAILED DESCRIPTION OF THE INVENTION

The following detailed description is of the best modes of carrying out the invention. The description is not to be taken in a limiting sense, but is made merely for the purpose of illustrating the general principles of the invention, since the scope of the invention is best defined by the appended claims.

The present invention generally provides a phased array antenna architecture having digitally controlled centralized beam forming. In a preferred embodiment of the invention, beam forming is centralized on an individual row basis. In another embodiment, beam forming may be centralized in a single unit for the entire array. In yet another embodiment, the phased array antenna may be partitioned, with each partition having separate centralized beam formers. This centralization provides for a grouping of array elements managed by centralized components as further described herein. One of the important considerations in the choice of these various embodiments is the minimum length, weight and volume of the digital distribution circuitry. In contrast, the prior art apparatus and methods provide for beam forming at discrete radiating elements, or fails to address it at all.

Figure 1:
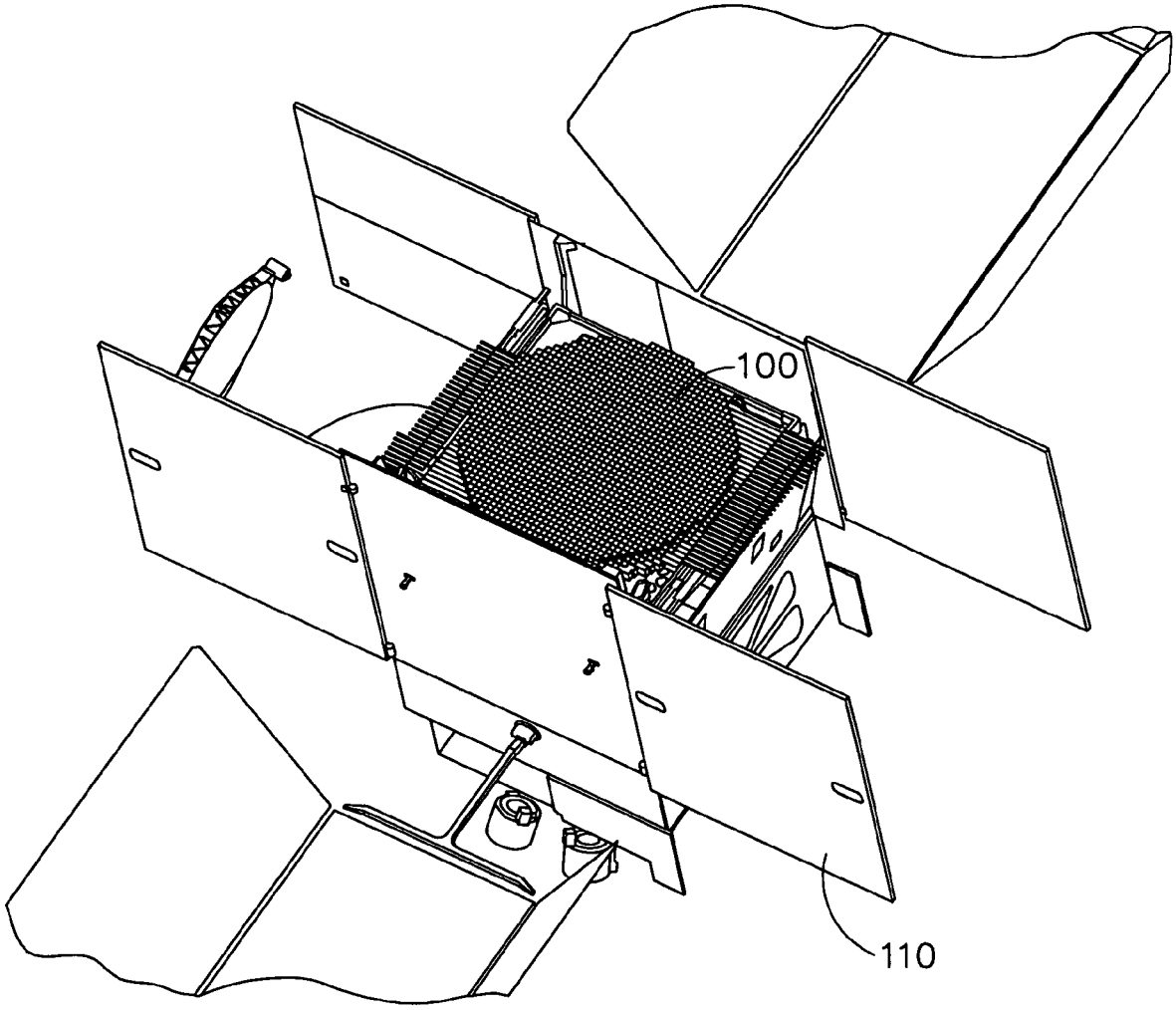
FIG. 1 is an isometric view of a satellite including a phased array in accordance with the present invention.

In one aspect of the invention, the phased array antenna 100 of the invention may be deployed in a spacecraft such as satellite 110 shown in FIG. 1.

Figure 2:
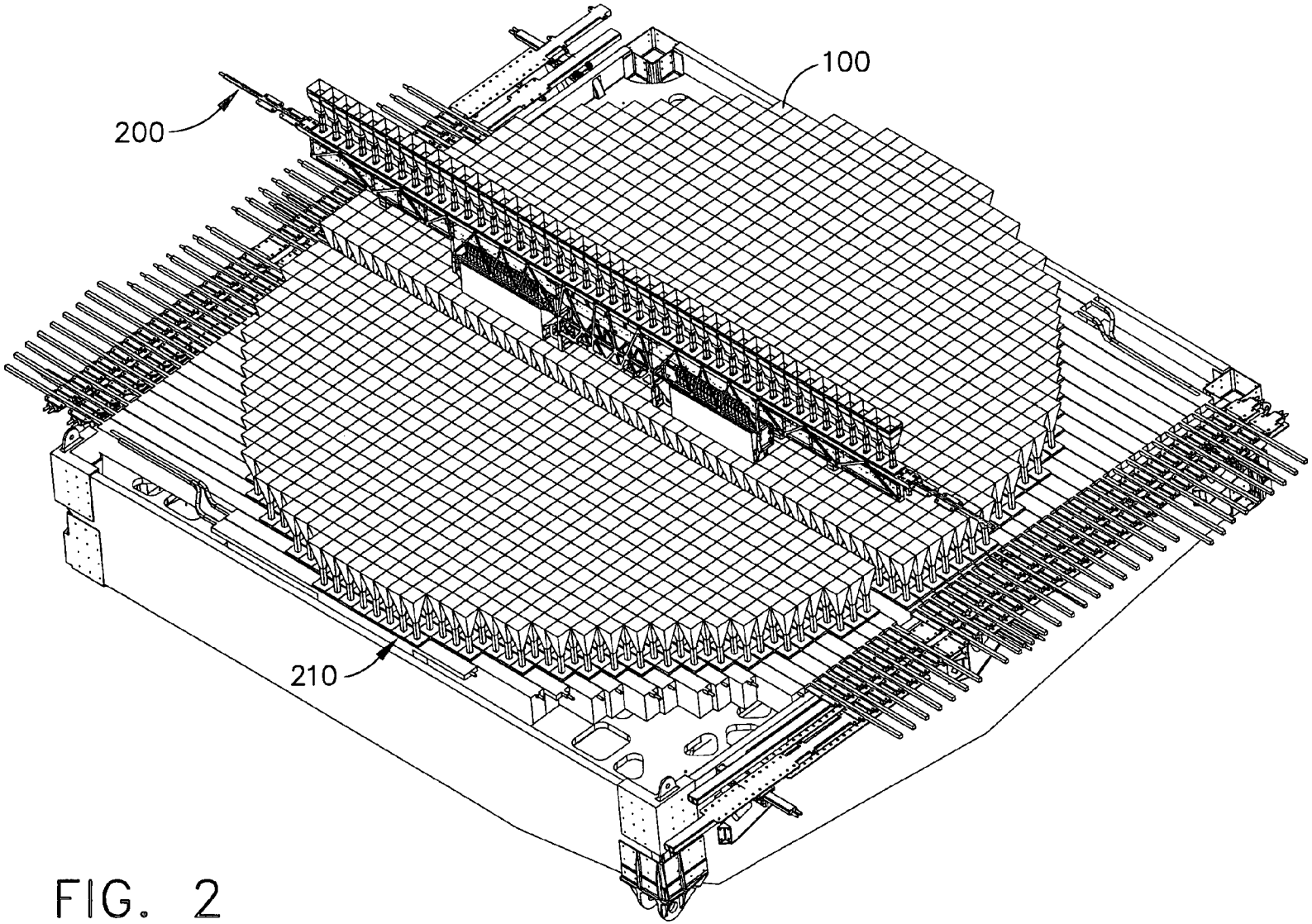
FIG. 2 is an isometric view of a phased array antenna in accordance with the present invention.

In another aspect of the invention and with reference to FIG. 2, a forty four (44) element row assembly 200 is shown lifted from the phased array antenna 100. Those skilled in the art will appreciate that row assemblies may include any number of elements including combined row assemblies such as three (3) row assembly 210.

Figure 3:
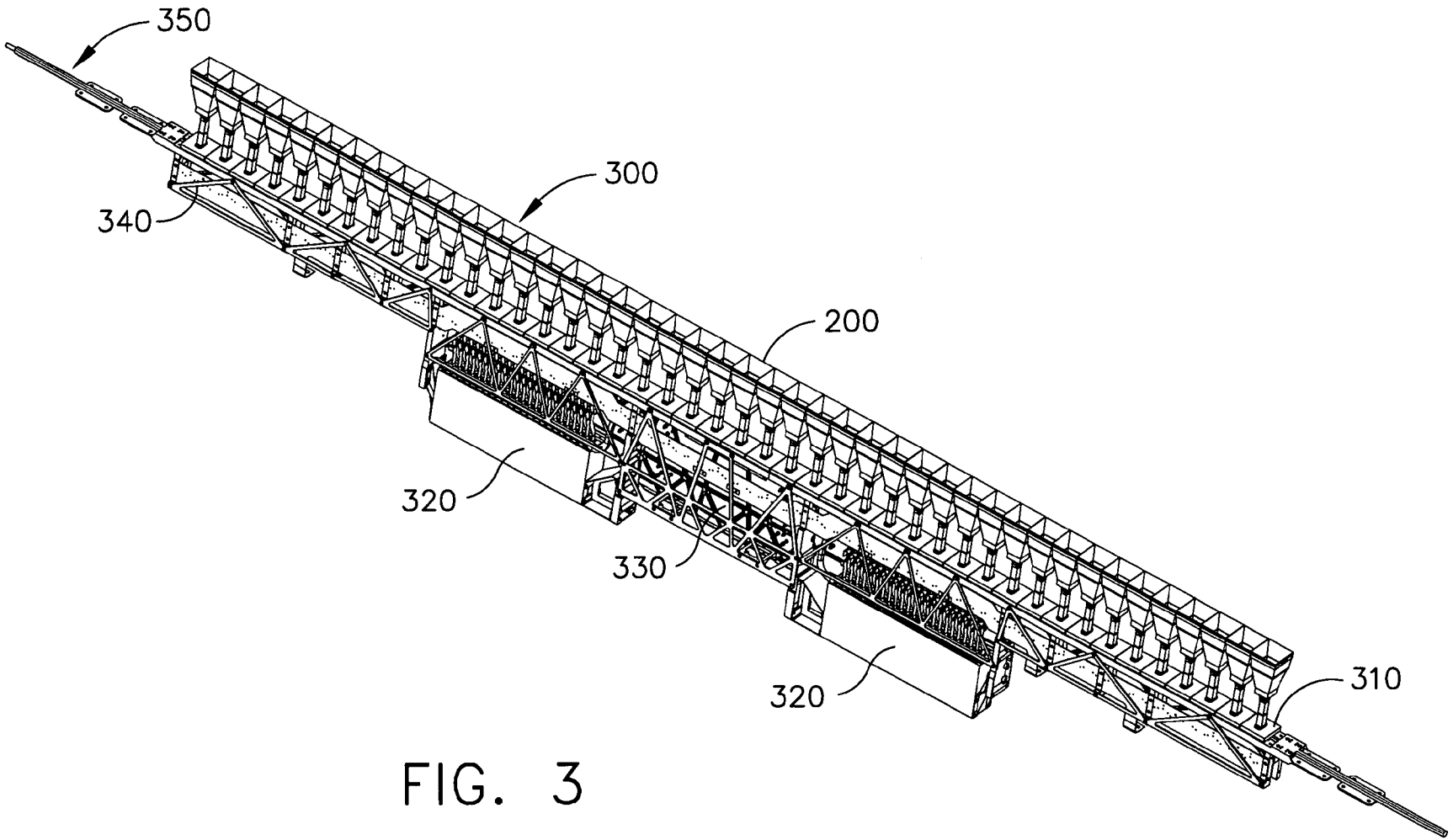
FIG. 3 is an isometric view of a row assembly in accordance with the present invention.

With reference to FIG. 3, there is shown row assembly 200 including a plurality of radiating elements 300 each having a horn, polarizer, and filter (not shown). Each radiating element 300 is shown coupled to a power amplifier module 310 which houses a power amplifier (not shown). Two beam forming modules 320 are shown disposed under the radiating elements 300. The beamforming modules consist of signal dividers, generally parallel to the rows, with the beam forming modules generally disposed orthogonally to the rows as in FIG. 6 and FIG. 7. Disposed between the beam forming modules 320 is shown a digital control module 330 which is operably coupled to each beam forming module 320. This arrangement minimizes the digital distribution distances and therefore mass, as one skilled in the art will readily appreciate. Cabling or waveguides (not shown) may be provided between beam forming modules 320 and radiating elements 300. A truss superstructure 340 may support the elements of the row assembly 200 and a heatpipe 350 may be operable to transport heat generated by the elements of the row assembly 200 to a thermal control subsystem (not shown) for dissipation.

Figure 4:
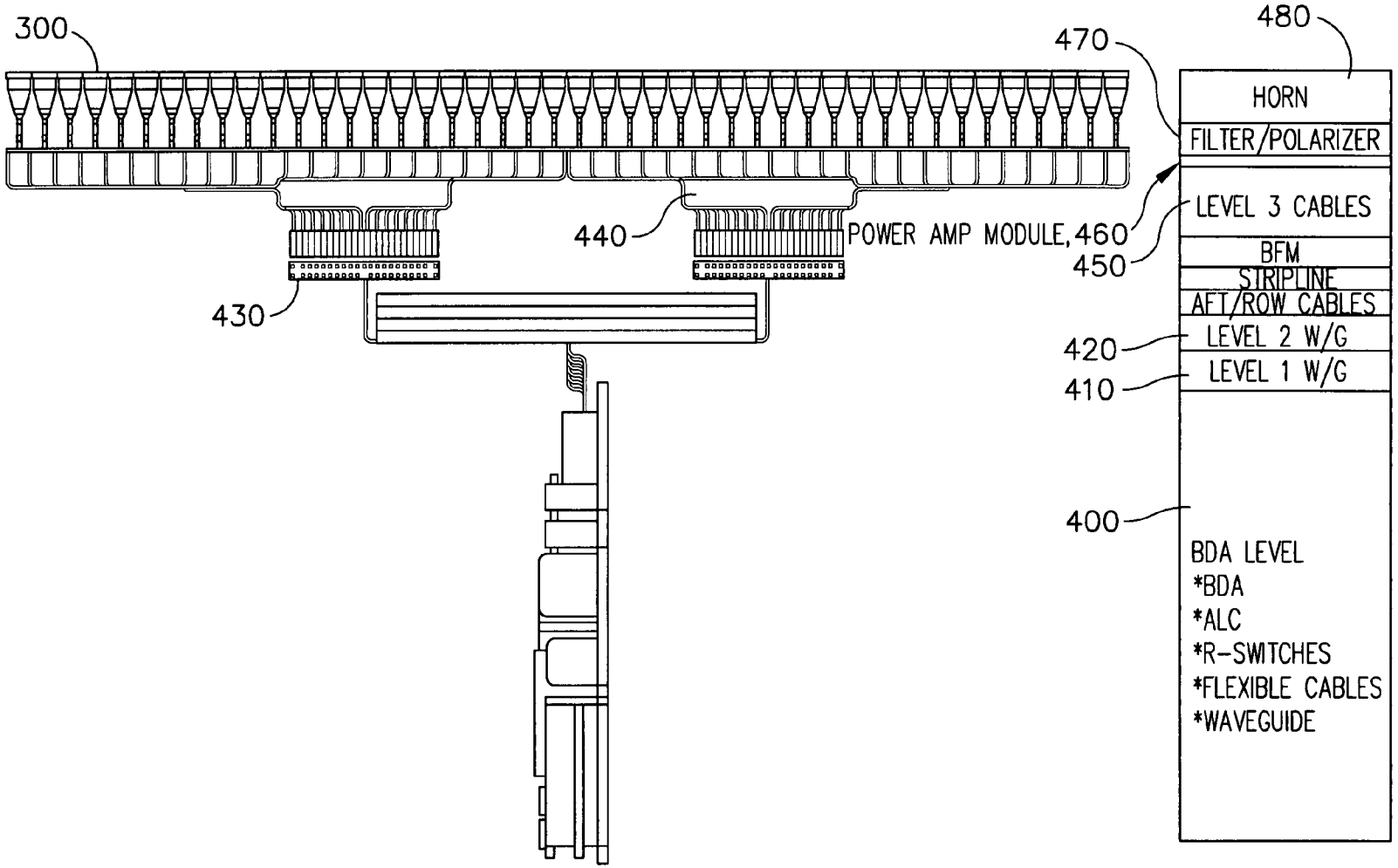
FIG. 4 is a plan view of the row assembly in accordance with the present invention.

In another aspect of the invention and with reference to FIG. 4, there is shown a partitioning of the functions within the phased array antenna 100. A beam driver layer 400 may include a preamplifier a beam driver amplifier, and redundant preamplifiers as those skilled in the art will readily appreciate. Level 1 410 and level 2 420 distribution layers may provide for distribution of signals for multiple beams to each of a plurality of row assemblies 200. A signal distribution layer 430 (600 in FIG. 6) may divide the signals to the row assemblies 200 for distribution to phase shifters and amplifier elements 500 as shown in FIG. 6.

With reference to FIG. 4 a beam forming layer 440 may include the beam forming modules 320 which may include a plurality of beam formers as further described herein and a signal divider layer 430 A level 3 layer 450 may provide for one-to-one distribution of one polarity output per beam former to one polarity input per radiating element 300. A power amplifier layer 460 may provide for amplification of each of two signals of differing polarities for transmission at each radiating element 300 and a filter/polarizer layer 470 may filter and polarize the signal. An antenna horn layer 480 may provide for antenna gain.

Figure 5:
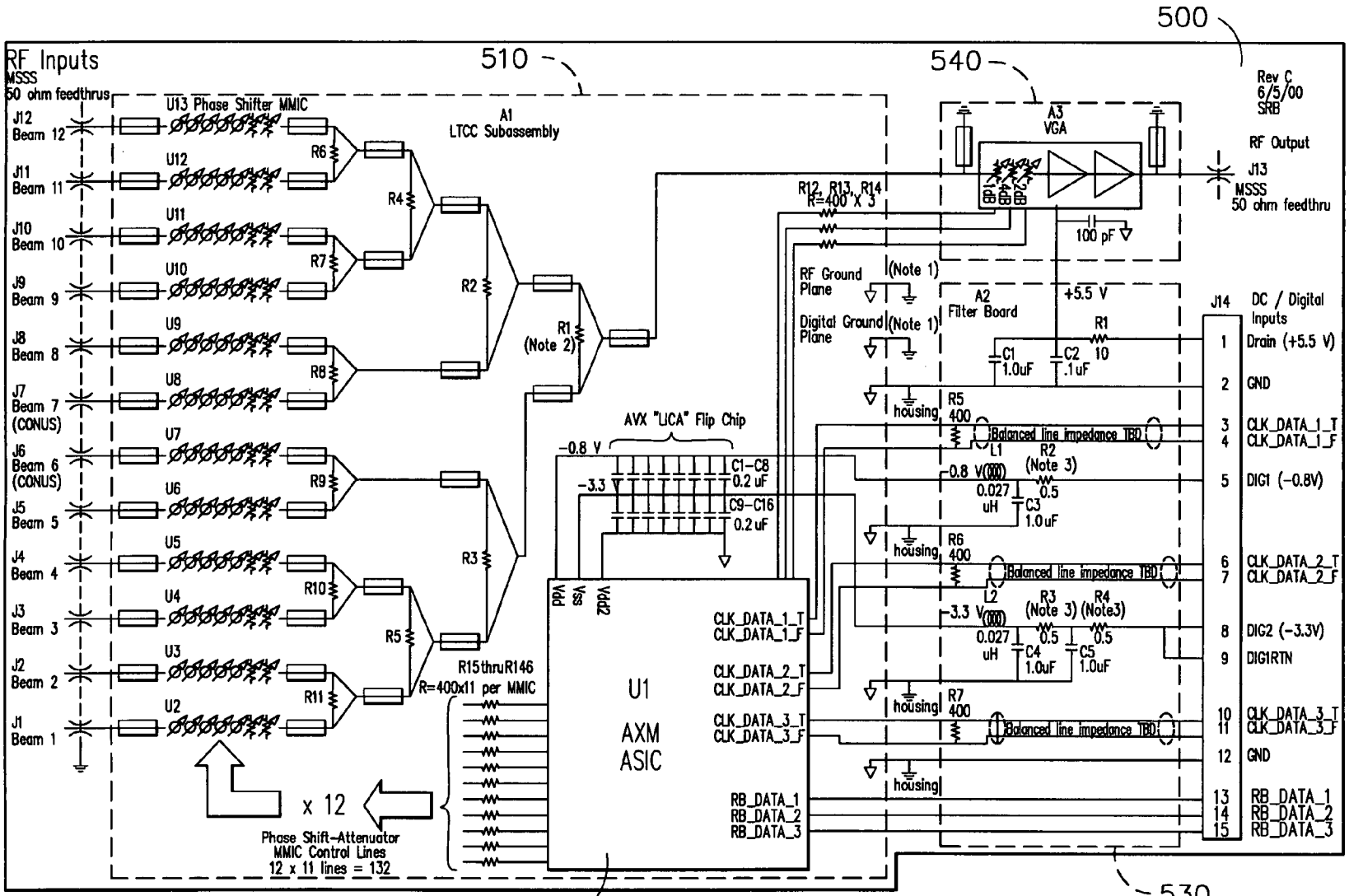
FIG. 5 is a circuit diagram of a beam former in accordance with the present invention.

With reference to FIG. 5 there is shown a beam former 500 of a beam forming module 320 in accordance with an embodiment of the invention. Twelve inputs are shown being phase shifted and combined in a circuit 510 into one input. These 12 inputs come from twelve orthogonally disposed signal dividers as illustrated in FIG. 6 and FIG. 7. A digital integrated circuit 520 may be operable to receive beam forming commands 530 and distribute them to the phase shifters. Before being output from the beam former 500, the combined output signal may be amplified by amplifier circuit 540 before being routed to the radiating elements 300. Placing amplifier ciruit 540 here greatly reduces total parasitic power and increases the digital distribution requirements by two or three bits within the existing harness or distribution board.

Figure 6:
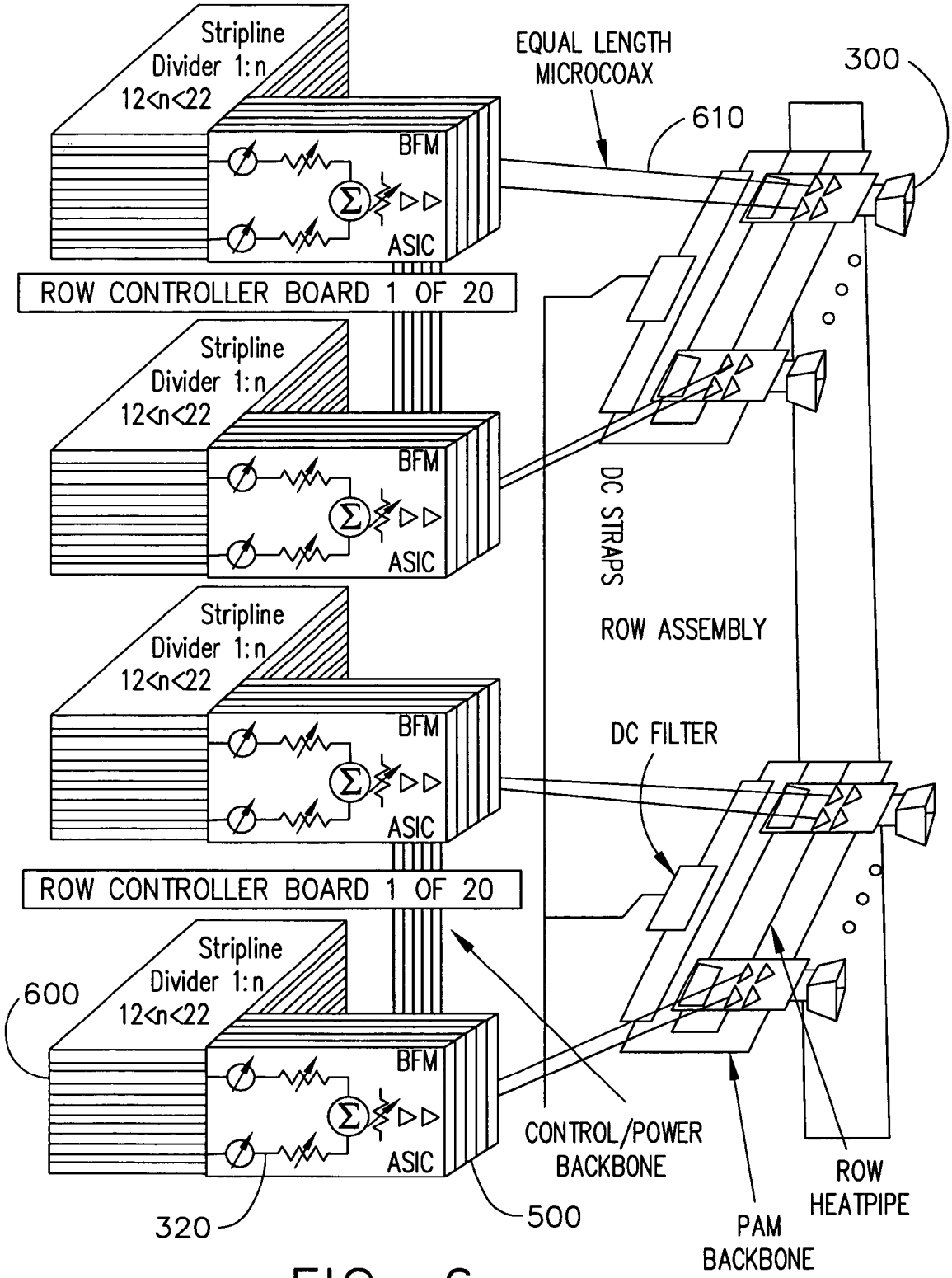
FIG. 6 is a block diagram showing a plurality of beam formers coupled to a plurality of dividing networks in the case of a transmitting antenna in accordance with the present invention.
Figure 7:
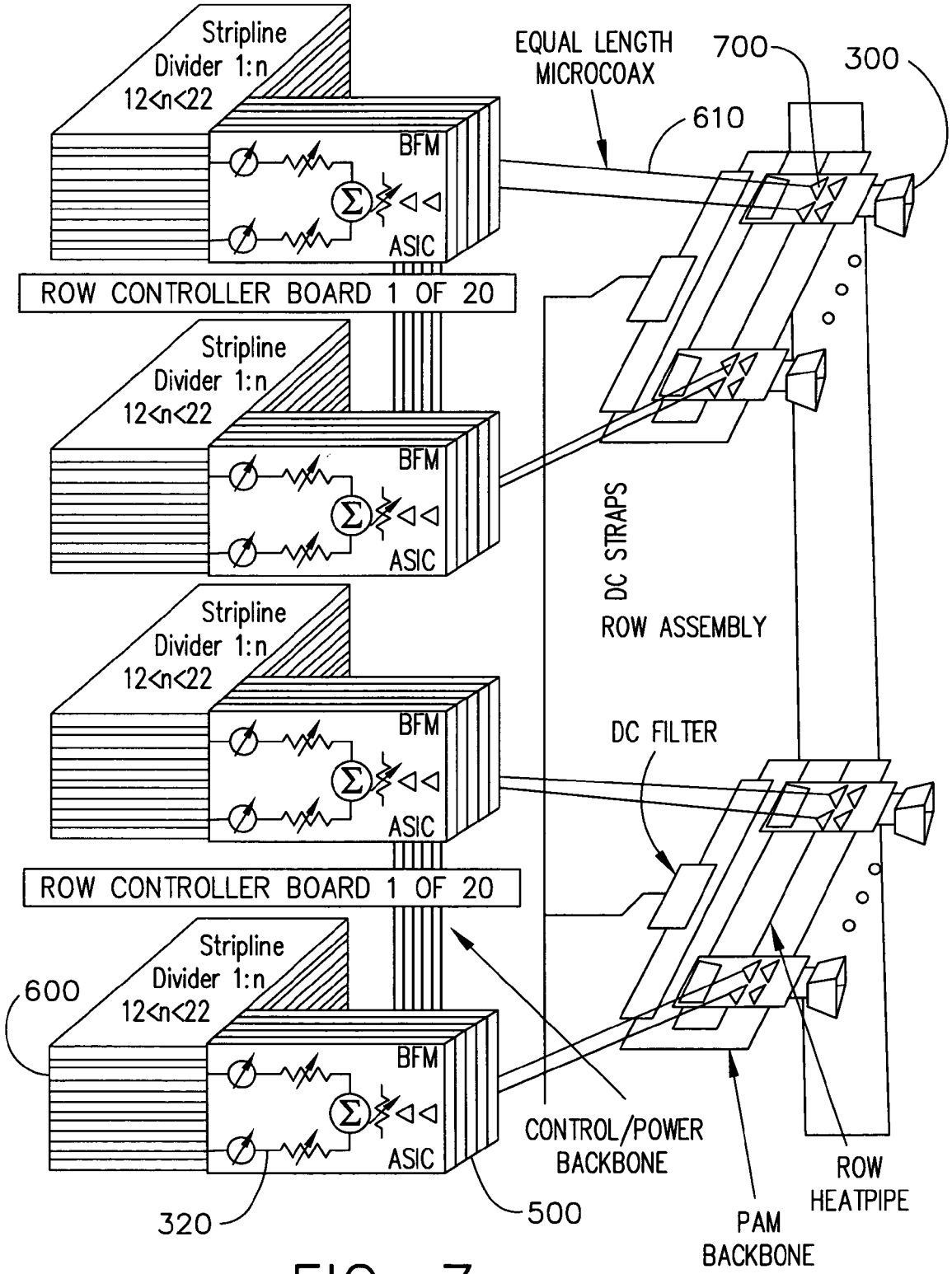
FIG. 7 is a block diagram showing a plurality of beam formers coupled to a plurality of dividing networks in the case of a receiving antenna in accordance with the present invention.

With reference to FIG. 6, there are shown beam forming modules 320 including a plurality of beam formers 500 coupled to signal dividing networks 600. From each beam former 500 equal length cables 610 or waveguides (not shown) may provide the signals to each radiating element 300, a first signal being representative of a plurality of signals for a first polarization such as inputs from circuit 510 and a second signal being representative of a plurality of signals for a second polarization. Such polarizations may include left-hand circular polarization, right-hand circular polarization, or vertical polarization and horizontal polarization.

Referring to FIG. 7, beam forming modules for a receiving antenna are shown including a plurality of beam formers 500 coupled to signal dividing networks 600. As will be appreciated by those skilled in the art, the signal flow of the beam forming modules for a receiving antenna is reversed from the signal flow for a transmitting antenna such as shown in FIG. 6, radiating elements 300 becoming receiving elements. Additionally, low noise amplifiers 700 are employed at the input.

Figure 8:
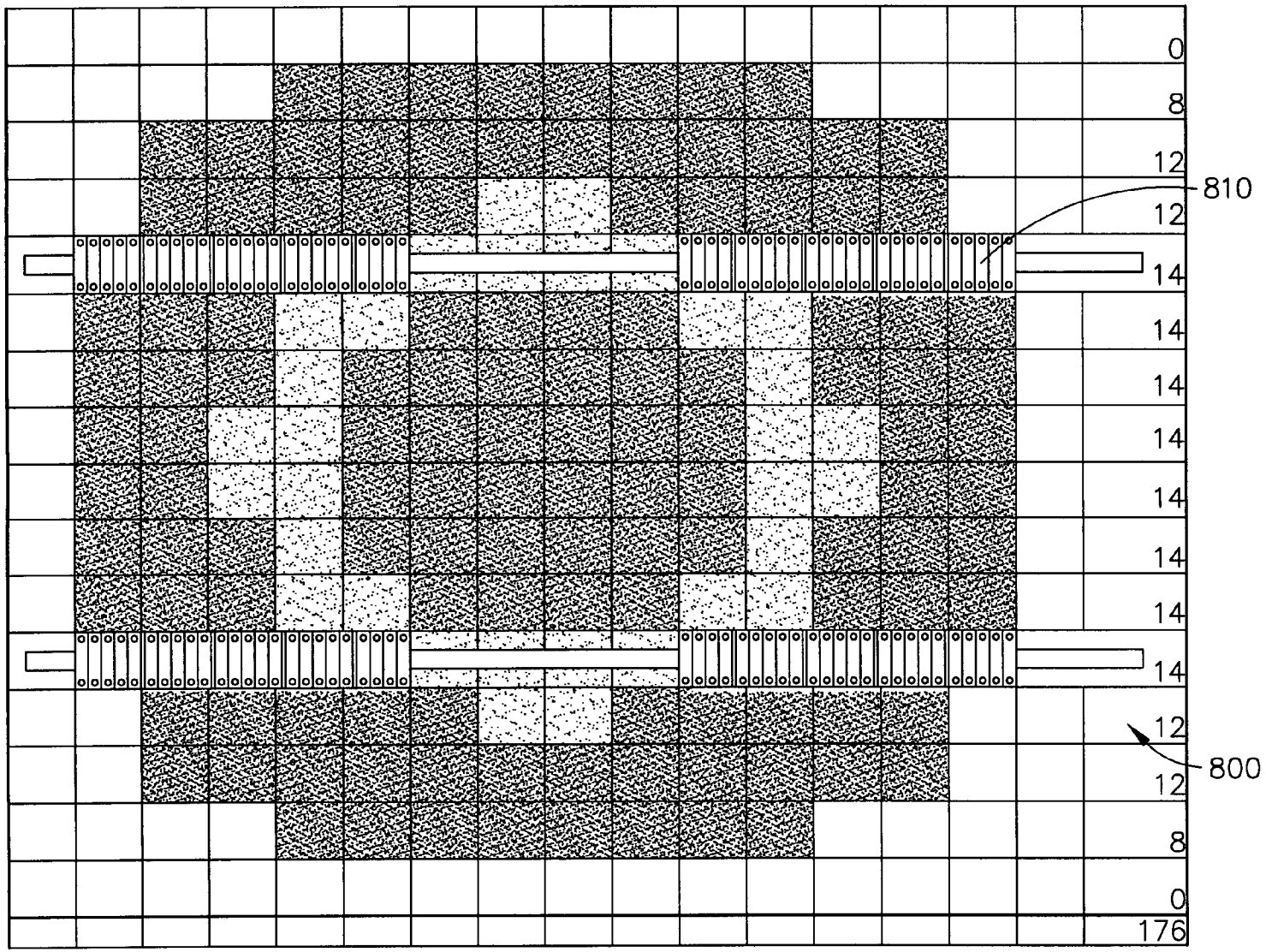
FIG. 8 is a plan view of an alternative embodiment of a phased array antenna in accordance with the present invention.

With reference to FIG. 8, there is shown an alternative embodiment of the phased array in accordance with the invention. A phased array antenna 800 may include quadrant assemblies 810, each quadrant assembly 810 further including a beam former module (shown by cutaway) disposed under the quadrant assembly 810.

The phased array antenna architecture having centralized beam forming may provide for the routing of a plurality of signals to the centralized beam forming modules 320 where individual radiating element phases are manipulated and the signals combined for output to the individual radiating elements 300. In this manner the architecture may provide for a simplified physical implementation of the phased array antenna in terms of both hardware complexity and density of distribution.

Though not illustrated, one skilled in the art will readily appreciate that the output of up to twelve beam forming modules may be input into a second set of beam formers such that the hardware illustrated may be redeployed to generate a system with a very large number of beams.

In accordance with another aspect of the invention, a method for distributing signals to a radiating element 300 of a phased array antenna 100 may include the steps of generating a first signal representative of a plurality of signals for a first polarization at a centralized beam former 500, and distributing the first signal to the radiating element 300. A second signal representative of plurality of signals for a second polarization may be generated and distributed to the radiating element 300. The first signal and the second signal may be combined in the horn/polarizer layer 470.

It should be understood, of course, that the foregoing relates to preferred embodiments of the invention and that modifications may be made without departing from the spirit and scope of the invention as set forth in the following claims.

We claim:

1. A phased array antenna comprising:

a plurality of assemblies, each assembly including a plurality of elements and a plurality of digitally controlled centralized beam formers coupled to respective ones of the plurality of elements, the centralized beam formers being operable to provide a first signal to the respective ones of the plurality of elements representative of a plurality of signals for a first polarization and a second signal representative of a plurality of signals for a second polarization.

2. The phased array antenna of claim 1, wherein the centralized beam formers are disposed under the plurality of elements.

3. The phased array antenna of claim 1, wherein the elements comprise radiating elements and the digitally controlled centralized beam formers are operable to provide a signal to the respective ones of the plurality of radiating elements representative of a plurality of signals.

4. The phased array antenna of claim 3, wherein the digitally controlled centralized beam formers are operable to provide a signal to the respective ones of the plurality of radiating elements representative of a polarization.

5. The phased array antenna of claim 4, wherein the polarization further comprises a left-hand circular polarization.

6. The phased array antenna of claim 4, wherein the polarization further comprises a right-hand circular polarization.

7. The phased array antenna of claim 4, wherein the polarization further comprises a vertical polarization.

8. The phased array antenna of claim 4, wherein the polarization further comprises a horizontal polarization.

9. The phased array antenna of claim 1, wherein the elements comprise receiving elements and the digitally controlled centralized beam formers are operable to receive a signal from the respective ones of the plurality of receiving elements representative of a plurality of signals.

10. The phased array antenna of claim 9, wherein the digitally controlled centralized beam formers are operable to receive a signal from the respective ones of the plurality of receiving elements representative of a polarization.

11. The phased array antenna of claim 10, wherein the polarization further comprises a left-hand circular polarization.

12. The phased array antenna of claim 10, wherein the polarization further comprises a right-hand circular polarization.

13. The phased array antenna of claim 10, wherein the polarization further comprises a vertical polarization.

14. The phased array antenna of claim 10, wherein the polarization further comprises a horizontal polarization.

15. The phased array antenna of claim 1, wherein the digitally controlled centralized beam formers are coupled to the respective ones of the elements by equal lengths of cable.

16. The phased array antenna of claim 1, wherein each of the plurality of elements further comprise a horn, a polarizer, and a filter.

17. The phased array antenna of claim 1, wherein each assembly further comprises two centralized beam formers and a digital control module operably coupled to the two centralized beam formers.

18. The phased array antenna of claim 1, wherein each of the plurality of centralized beam formers further comprise an integrated circuit for receiving a phase shifted input representing a combination of inputs, for receiving beam forming commands, and for distributing the beam forming commands and the phased shifted input to phase shifters and a control circuitry, and a combining network coupled to the integrated circuit.

19. The phased array antenna of claim 1, wherein each assembly comprises a row assembly.

20. The phased array antenna of claim 1, wherein each assembly comprises a quadrant assembly.

21. A phased array antenna comprising:

a plurality of assemblies, each assembly including a plurality of radiating elements and a plurality of digitally controlled centralized beam formers coupled to respective ones of the plurality of radiating elements, the centralized beam formers being disposed under the plurality of radiating elements and being operable to provide a first signal to the respective ones of the plurality of radiating elements representative of a plurality of signals for a first polarization and a second signal representative of a plurality of signals for a second polarization.

22. The phased array antenna of claim 21, wherein the polarization further comprises a left-hand circular polarization.

23. The phased array antenna of claim 21, wherein the polarization further comprises a right-hand circular polarization.

24. The phased array antenna of claim 21, wherein the polarization further comprises a vertical polarization.

25. The phased array antenna of claim 21, wherein the polarization further comprises a horizontal polarization.

26. The phased array antenna of claim 21, wherein the centralized beam formers are coupled to the respective ones of the radiating elements by equal lengths of cable.

27. The phased array antenna of claim 21, wherein each of the plurality of radiating elements further comprise a horn, a polarizer, and a filter.

28. The phased array antenna of claim 21, wherein the polarizer is operable to receive the first signal and the second signal.

29. The phased array antenna of claim 21, wherein each assembly further comprises two centralized beam formers and a digital control module operably coupled to the two centralized beam formers.

30. The phased array antenna of claim 21, wherein each of the plurality of centralized beam formers further comprise an integrated circuit for receiving a phase shifted input representing a combination of inputs, for receiving beam forming commands, and for distributing the beam forming commands and the phased shifted input to phase shifters and a control circuitry, and a combining network coupled to the integrated circuit.

31. A phased array antenna comprising:

a plurality of assemblies, each assembly including a plurality of receiving elements and a plurality of centralized beam formers coupled to respective ones of the plurality of receiving elements, the centralized beam formers being disposed under the plurality of receiving elements and being operable to receive a first signal from the respective ones of the plurality of receiving elements representative of a plurality of signals of a first polarization and a second signal representative of a plurality of signals of a second polarization.

32. A row assembly for use in a phased array antenna comprising:

a plurality of radiating elements; and a plurality of digitally controlled centralized beam formers coupled to respective ones of the plurality of radiating elements, the centralized beam formers being operable to provide a first signal to the respective ones of the plurality of radiating elements representative of a plurality of signals for a first polarization and a second signal representative of a plurality of signals for a second polarization.

33. The row assembly of claim 32, wherein the centralized beam formers are disposed under the plurality of radiating elements.

34. The row assembly of claim 32, wherein the centralized beam formers are operable to provide a signal to the respective ones of the plurality of radiating elements representative of a plurality of signals.

35. The row assembly of claim 32, wherein the centralized beam formers are operable to provide a signal to the respective ones of the plurality of radiating elements representative of a polarization.

36. The row assembly of claim 32, wherein the centralized beam formers are coupled to the respective ones of the radiating elements by equal lengths of cable.

37. A row assembly for use in a phased array antenna comprising:

a plurality of receiving elements; and a plurality of digitally controlled centralized beam formers coupled to respective ones of the plurality of receiving elements, the centralized beam formers being operable to receive a first signal to the respective ones of the plurality of receiving elements representative of a plurality of signals for a first polarization and a second signal representative of a plurality of signals for a second polarization.

38. The row assembly of claim 37, wherein the centralized beam formers are disposed under the plurality of receiving elements.

39. The row assembly of claim 37, wherein the centralized beam formers are operable to receive a signal to the respective ones of the plurality of receiving elements representative of a plurality of signals.

40. The row assembly of claim 37, wherein the centralized beam formers are operable to receive a signal to the respective ones of the plurality of receiving elements representative of a polarization.

41. The row assembly of claim 37, wherein the centralized beam formers are coupled to the respective ones of the receiving elements by equal lengths of cable.

42. A satellite system comprising:

a satellite;

a phased array antenna disposed upon the satellite, the phased array antenna including a plurality of assemblies, each assembly having a plurality of elements and a plurality of digitally controlled centralized beam formers coupled to respective ones of the plurality of elements, the centralized beam formers being operable to provide a first signal to the respective ones of the plurality of elements representative of a plurality of signals for a first polarization and a second signal representative of a plurality of signals for a second polarization.

43. The system of claim 42, wherein the centralized beam formers are disposed under the plurality of elements.

44. The system of claim 42, wherein the elements comprise radiating elements and wherein the centralized beam formers are operable to provide a signal to the respective ones of the plurality of radiating elements representative of a plurality of signals.

45. The system of claim 44, wherein the centralized beam formers are operable to provide a signal to the respective ones of the plurality of radiating elements representative of a polarization.

46. The system of claim 42, wherein the elements comprise receiving elements and wherein the centralized beam formers are operable to receive a signal to the respective ones of the plurality of receiving elements representative of a plurality of signals.

47. The system of claim 46, wherein the centralized beam formers are operable to provide a signal to the respective ones of the plurality of radiating elements representative of a polarization.

48. The system of claim 42, wherein the centralized beam formers are coupled to the respective ones of the elements by equal lengths of cable.

49. A method for distributing signals to a radiating element of a phased array antenna comprising the steps of:

(a) generating a first signal representative of a plurality of signals of a first polarization at a centralized beam former; and (b) distributing the first signal to the radiating element;

(c) generating a second signal representative of a plurality of signals of a second polarization at the centralized beam former; and (d) distributing the second signal to the radiating element.

50. The method of claim 49, wherein the first polarization further comprises a left-hand circular polarization.

51. The method of claim 49, wherein the first polarization further comprises a right-hand circular polarization.

52. The method of claim 49, wherein the second polarization further comprises a vertical polarization.

53. The method of claim 49, wherein the second polarization further comprises a horizontal polarization.

54. The method of claim 49, wherein the first polarization further comprises a vertical polarization.

55. The method of claim 49, wherein the second polarization further comprises a left-hand circular polarization.

56. The method of claim 49, wherein the radiating element is disposed in an assembly.

57. The method of claim 56, wherein the centralized beam former is disposed under the assembly.

* * * * *